US011906187B2

(12) United States Patent
Matsumoto

(10) Patent No.: US 11,906,187 B2
(45) Date of Patent: Feb. 20, 2024

(54) REFRIGERATING CYCLE APPARATUS, REFRIGERATING CYCLE CONTROL SYSTEM, AND REFRIGERATING CYCLE CONTROL METHOD

(71) Applicant: Mitsubishi Electric Corporation, Tokyo (JP)

(72) Inventor: Takashi Matsumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 359 days.

(21) Appl. No.: 17/441,417

(22) PCT Filed: May 23, 2019

(86) PCT No.: PCT/JP2019/020371
§ 371 (c)(1),
(2) Date: Sep. 21, 2021

(87) PCT Pub. No.: WO2020/235071
PCT Pub. Date: Nov. 26, 2020

(65) Prior Publication Data

US 2022/0178573 A1 Jun. 9, 2022

(51) Int. Cl.
*F25B 1/00* (2006.01)
*F24F 11/65* (2018.01)
(Continued)

(52) U.S. Cl.
CPC ..... *F24F 11/65* (2018.01); *F24F 11/48* (2018.01); *F24F 11/56* (2018.01)

(58) Field of Classification Search
CPC ..... F24F 11/65; F24F 11/48; F24F 11/56
(Continued)

(56) References Cited

U.S. PATENT DOCUMENTS

2003/0033392 A1 2/2003 Nakamura et al.
2015/0136379 A1 5/2015 Takeda et al.
(Continued)

FOREIGN PATENT DOCUMENTS

CN 101672498 A * 3/2010
JP H10-232044 A 9/1998
(Continued)

OTHER PUBLICATIONS

Office Action dated Nov. 15, 2022 in corresponding JP Patent Application No. 2021-094020 (with English translation).
(Continued)

*Primary Examiner* — Davis D Hwu
(74) *Attorney, Agent, or Firm* — POSZ LAW GROUP, PLC

(57) ABSTRACT

A refrigerating cycle apparatus includes a refrigerating cycle device having a refrigerating cycle, the refrigerating cycle in which a refrigerant is compressed in a compressor and made to circulate, and by a heat exchanger, heat is absorbed from a low temperature heat source and heat is exhausted to a high temperature heat source, and a control device that controls operation of the refrigerating cycle device. An obtaining unit obtains an operation operating request that controls the refrigerating cycle device arranged in a structure's interior to a target state. An operation control unit, when the operation operating request transmitted from an outside is obtained, controls the refrigerating cycle device to the target state with lower operation capacity than operation capacity of the refrigerating cycle device of a case where the operation operating request is transmitted from the structure's interior.

9 Claims, 10 Drawing Sheets

(51) Int. Cl.
*F24F 11/48* (2018.01)
*F24F 11/56* (2018.01)

(58) Field of Classification Search
USPC ..... 62/228.1
See application file for complete search history.

(56) References Cited

U.S. PATENT DOCUMENTS

| | | | |
|---|---|---|---|
| 2017/0138625 | A1 | 5/2017 | Shiratori |
| 2018/0045474 | A1 | 2/2018 | Yoshikawa |

FOREIGN PATENT DOCUMENTS

| | | | |
|---|---|---|---|
| JP | 2000-161756 | A | 6/2000 |
| JP | 2000-184080 | A | 6/2000 |
| JP | 2003-056889 | A | 2/2003 |
| JP | 2003-166743 | A | 6/2003 |
| JP | 2003-284161 | A | 10/2003 |
| JP | 2010-151342 | A | 7/2010 |
| JP | WO2015001607 | A1 * | 7/2013 |
| JP | 2014-001907 | A | 1/2014 |
| JP | 2014-070782 | A | 4/2014 |
| JP | 2015-010769 | A | 1/2015 |
| JP | 2015-078826 | A | 4/2015 |
| JP | 2015-114031 | A | 6/2015 |
| JP | 2015-172443 | A | 10/2015 |
| JP | 2015-224858 | A | 12/2015 |
| JP | 2016-169938 | A | 9/2016 |
| JP | 2017-053517 | A | 3/2017 |
| JP | 2018-021710 | A | 2/2018 |
| JP | 2019-045050 | A | 3/2019 |
| WO | 2013/144780 | A1 | 10/2013 |
| WO | 2013/172279 | A1 | 11/2013 |

OTHER PUBLICATIONS

Office Action dated Apr. 29, 2023 for the corresponding CN Patent Application No. 201980096524.6 (and English machine translation).
Office Action dated Oct. 11, 2022 issued in corresponding Japanese Patent Application No. 2021-519998 (and English machine translation).
Office Action dated May 24, 2022 for the corresponding JP Patent Application No. 2021-094020 (and English machine translation).
Office Action dated Jun. 7, 2022 for the corresponding JP Patent Application No. 2021-519998 (and English machine translation).
International Search Report dated Jul. 23, 2019, issued in corresponding International Application No. PCT/JP2019/020371 (and English Machine Translation).
Office Action dated Oct. 9, 2022 in corresponding CN Application No. 201980096524.6 (with English translation).
Office Action dated Dec. 20, 2022 issued in corresponding Japanese Patent Application No. 2021-519998 (and English translation).

* cited by examiner

Fig. 9

21 : LIFESTYLE LOG 521 522

| LIFESTYLE | | | | LIVING AREA | |
|---|---|---|---|---|---|
| SEASON | WEATHER | DAY ATTRIBUTE | DAILY LIFE SITUATION | ANGLE OF ROTATION | ... |
| SPRING | ... | WEEKDAY | BREAKFAST : 07:00～08:00 | 140° ～215° | |
| | | | ... | | |
| | | | 20:00～22:00 | 215° ～260° | |
| | | | ... | | |
| | | WEEKEND | BREAKFAST : 9:30～11:00 | 140° ～215° | |
| | | | ... | | |
| | | | 21:00～24:00 | 215° ～275° | |
| | | | ... | | |
| ... | ... | | | ... | ... |

REFRIGERATING CYCLE APPARATUS, REFRIGERATING CYCLE CONTROL SYSTEM, AND REFRIGERATING CYCLE CONTROL METHOD

CROSS REFERENCE TO RELATED APPLICATION

This application is a U.S. National Stage Application of International Application No. PCT/JP2019/020371, filed on May 23, 2019, the contents of which are incorporated herein by reference.

TECHNICAL FIELD

The present invention relates to a refrigerating cycle apparatus, a refrigerating cycle control system, and a refrigerating cycle control method.

BACKGROUND

In people's daily lives in recent years, a trend towards the nuclear family is growing and dual-income families are increasing, and as for houses, there are many times when air conditioners are turned off when leaving the house during the day. Consequently, when a family member returns home, a room is humid and hot in summertime, and the room is cold in wintertime, meaning that the family member returns to an uncomfortable house. Consequently, there is increasing demand for operation of the air conditioner from a place where one has gone out to before returning home. Furthermore, there are cases where operation of the air conditioner is desired to be done from a place where one has gone out to for health management of members of the family that are unable to control electronic devices such as a person receiving home care or a pet. There are also cases where operation of an air conditioner is desired to be done from a place where one has gone out to for preventing decay of a house such as a vacation home that is usually empty.

Patent Literature 1 discloses technology for operating an air conditioner from a place where one has gone out to by an information terminal device such as cellular phone, a smartphone, or a tablet computer using Wi-Fi (registered trademark) wireless.

PATENT LITERATURE

Patent Literature 1: JP 2015-010769 A

Since an air conditioner that uses a refrigerating cycle does not use fire, the air conditioner has higher degree of safety than other air conditioners such as combustion heaters. Accidents, however, do occur even in the air conditioner that uses the refrigerating cycle due to factors such as poor construction such as a power wiring contact failure, a failure in a power line due to various reasons, or devices becoming too old to use.

It is known that the air conditioner that uses the refrigerating cycle uses a large percentage of electric power among electric power used in a home. Especially, at a start of operation of an air conditioner that uses an inverter-driven refrigerating cycle, capacity necessary for heating or cooling a room, that is, an air conditioning load, is large. Consequently, operation is to be done with cooling capacity or heating capacity being high in capacity, and electric power used will be greater. As described, a possibility of an accident occurring becomes high when some kind of a problem occurs in an electrical system at the start of operation of the air conditioner that uses the refrigerating cycle.

As disclosed in Patent Literature 1, in a case where an air conditioner is to be operated from a place where one has gone out to, there is an issue where a risk of an accident occurring becoming high at a start of operation because a possibility of a person managing the air conditioner not being present is high.

SUMMARY

The present invention aims to prevent an accident occurring at a start of operation even in a case where operating a refrigerating cycle device such as an air conditioner from a place where one has gone out to.

A refrigerating cycle apparatus according to the present invention includes:

- a refrigerating cycle device having a refrigerating cycle, the refrigerating cycle in which a refrigerant is compressed in a compressor and made to circulate, and by a heat exchanger, heat is absorbed from a low temperature heat source and heat is exhausted to a high temperature heat source; and
- a control device to control operation of the refrigerating cycle device, wherein the control device includes

- an obtaining unit to obtain an operation operating request that controls the refrigerating cycle device arranged in a structure's interior to a target state, and
- an operation control unit, when the operation operating request transmitted from an outside is obtained, to control the refrigerating cycle device to the target state with lower operation capacity than operation capacity of the refrigerating cycle device of a case where the operation operating request is transmitted from the structure's interior.

In a refrigerating cycle apparatus according to the present invention, in a case where a refrigerating cycle device is to be operated from an outside, since the refrigerating cycle device will be controlled to a target state with low operation capacity, occurrence of an accident during operation operating can be prevented.

BRIEF DESCRIPTION OF DRAWINGS

FIG. 9 is a diagram illustrating an example of a lifestyle log according to Embodiment 2.

DETAILED DESCRIPTION

The present embodiments will be described hereinafter using the drawings. Throughout the drawings, the same or corresponding portions are denoted by the same reference signs. In the description of the embodiments, a description of the same or corresponding portions will be suitably omitted or simplified. Note that the embodiments are not limited to the embodiments to be described hereinafter, and various modifications are possible as necessary. Specifically, two or more embodiments of the embodiments to be described hereinafter may be implemented in combination. Alternatively, one embodiment or a combination of two or more embodiments of the embodiments to be described hereinafter may be partially implemented.

Embodiment 1

The present embodiment will be described using FIG. 1 to FIG. 6.

Description of Configuration

Figure 1:
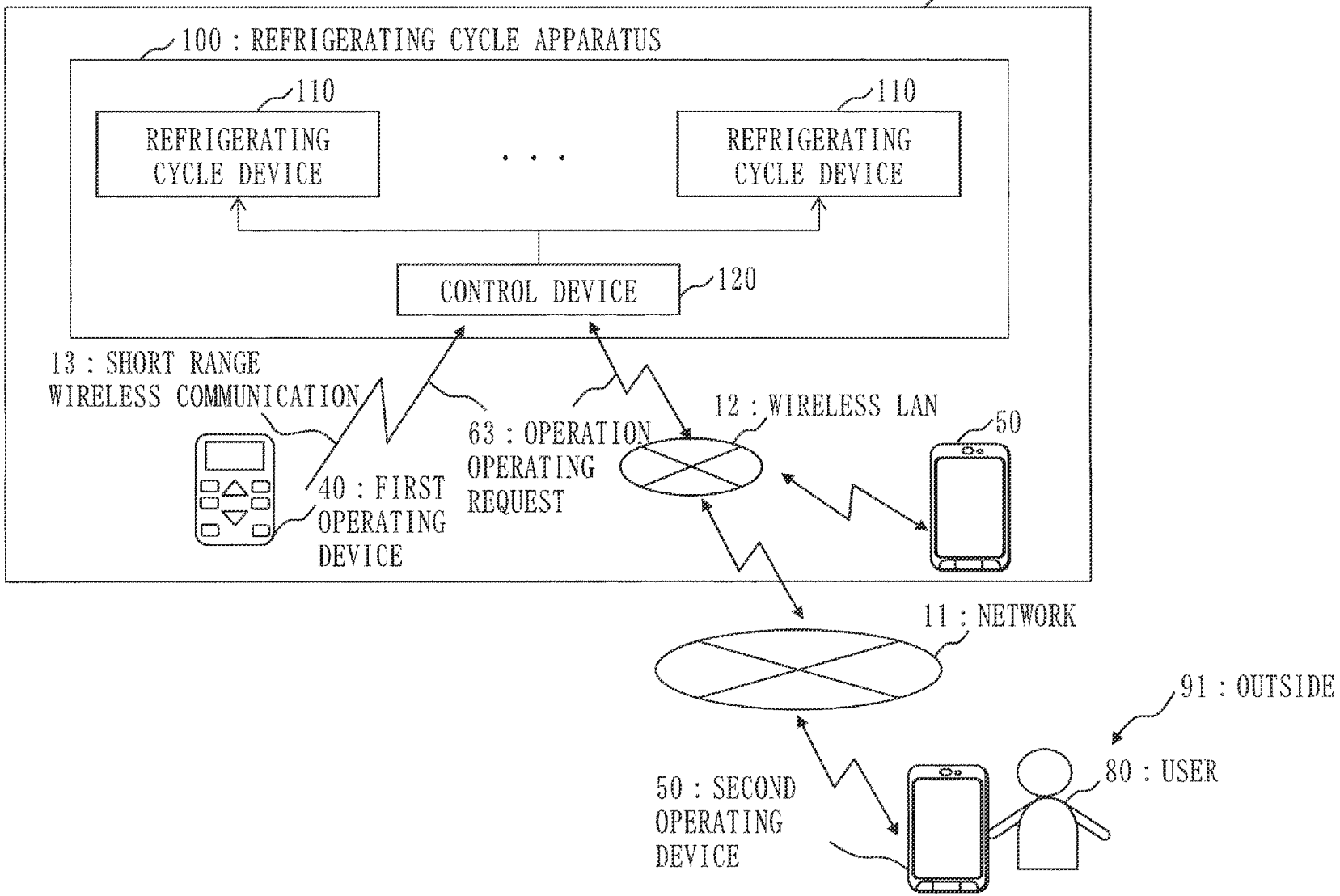
FIG. 1 is an overall configuration diagram including a refrigerating cycle apparatus according to Embodiment 1.

FIG. 1 is an overall configuration diagram including a refrigerating cycle apparatus 100 according to the present embodiment.

The refrigerating cycle apparatus 100 is arranged in a structure's interior 90. The structure's interior 90 is, an interior of a structure such as a house, a building, or a factory where a refrigerating cycle device 110 is arranged.

The refrigerating cycle apparatus 100 includes the refrigerating cycle device 110 and a control device 120.

The refrigerating cycle device 110 is a device that has a refrigerating cycle in which a refrigerant is compressed in a compressor and made to circulate, and by a heat exchanger, heat is absorbed from a low temperature heat source and heat is exhausted to a high temperature heat source. Specifically, a device such as an air conditioner, floor heating, or a hot water supply is included in the refrigerating cycle device 110.

The control device 120 controls operation of the refrigerating cycle device 110. In a case where the refrigerating cycle device 110 is in plurality, the control device 120 controls operation of a plurality of refrigerating cycle devices 110.

In FIG. 1, although a refrigerating cycle device is configured of the plurality of refrigerating cycle devices 110, the present embodiment is applicable even when there is one refrigerating cycle device.

The control device 120, specifically, is a microcomputer. The control device 120 controls the refrigerating cycle device 110 based on an operation operating request 63 transmitted from a first operating device 40. The control device 120 controls the refrigerating cycle device 110 based on the operation operating request 63 transmitted from a second operating device 50.

The operation operating request 63 is an instruction that requests the refrigerating cycle device 110 arranged in the structure's interior 90 be controlled to a target state. The target state is a state of the refrigerating cycle device 110 that a user 80 desires. Specifically, in a case of an air conditioner, the state such as temperature, wind volume, wind direction, and air conditioning type. In a case of floor heating, the state such as temperature, heating area, and heating type. In a case of a hot water supply, the state such as temperature and amount of hot water.

The first operating device 40 transmits the operation operating request 63 to the control device 120 using short range wireless communication 13 such as infrared communication or Bluetooth (registered trademark). The first operating device 40, specifically, is a remote control. Or, the first operating device 40 may be an operating device such as a switch provided on the control device 120.

The first operating device 40 is used by the user 80 in the structure's interior 90. That is, the operation operating request 63 from the first operating device 40 is transmitted from the structure's interior 90.

The second operating device 50 communicates with the control device 120 using a wireless LAN 12 such as Wi-Fi (registered trademark). The second operating device 50, specifically, is a personal computer, a smartphone, a cellular phone, or a tablet computer. The second operating device 50 is a communication terminal that is more sophisticated than the first operating device 40. The second operating device 50 transmits the operation operating request 63 to the control device 120 using the wireless LAN 12.

The second operating device 50 is used in the structure's interior 90 and on an outside 91 by the user 80. That is, there is a case where the operation operating request 63 from the second operating device 50 is transmitted from the structure's interior 90 and a case where the operation operating request 63 is transmitted from the outside 91. In a case where the operation operating request 63 is to be transmitted from the second operating device 50 on the outside 91, the second operating device 50 connects to the wireless LAN 12 in the structure's interior 90 via a network 11 such as an Internet. That is, the second operating device 50 on the outside 91 transmits the operation operating request 63 to the control device 120 via the network 11 and the wireless LAN 12.

A configuration of the refrigerating cycle apparatus 100 according to the present embodiment will be described using FIG. 2 and FIG. 3.

Figure 2:
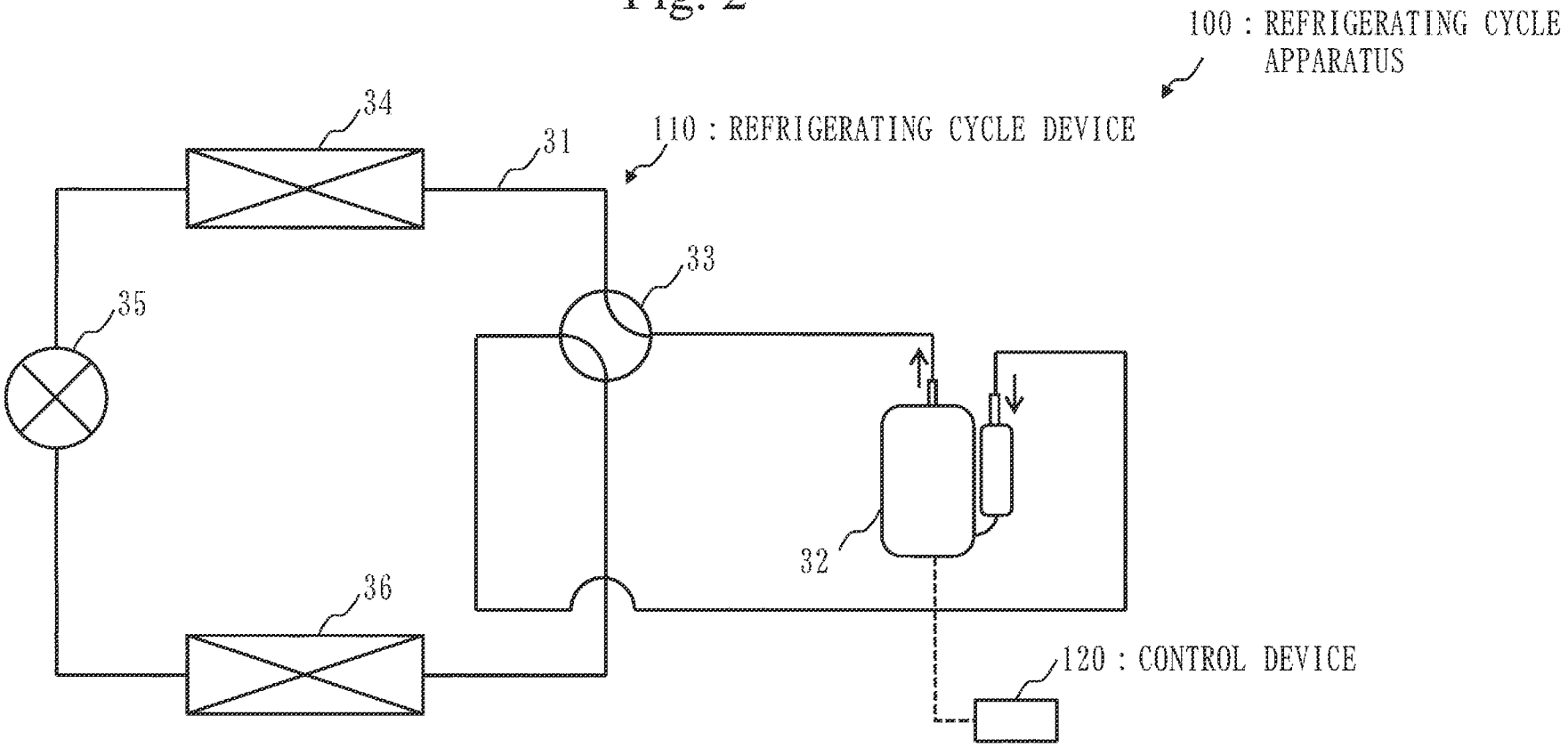
FIG. 2 is a refrigerant circuit during cooling operation in a case where a refrigerating cycle device is an air conditioner.

FIG. 2 illustrates a refrigerant circuit 31 during cooling operation in a case where the refrigerating cycle device 110 is an air conditioner. FIG. 3 illustrates a refrigerant circuit 31 during heating operation in a case where the refrigerating cycle device 110 is an air conditioner.

The refrigerating cycle device 110 includes the refrigerant circuit 31 in which the refrigerant circulates. The refrigerating cycle device 110, furthermore, includes a compressor 32, a four-way valve 33, a first heat exchanger 34 that is an outdoor heat exchanger, an expansion mechanism 35 that is an expansion valve, and a second heat exchanger 36 that is an indoor heat exchanger. The compressor 32, the four-way valve 33, the first heat exchanger 34, the expansion mechanism 35, and the second heat exchanger 36 are connected to the refrigerant circuit 31.

The compressor 32 compresses the refrigerant. The four-way valve 33 switches a flowing direction of the refrigerant between the cooling operation and the heating operation. In the cooling operation, the first heat exchanger 34 operates as a condenser to dissipate heat of the refrigerant compressed by the compressor 32. That is, the first heat exchanger 34 performs heat exchange using the refrigerant compressed by the compressor 32. In the heating operation, the first heat exchanger 34 operates as an evaporator to heat the refrigerant by performing heat exchange between outdoor air and the refrigerant expanded by the expansion mechanism 35. The expansion mechanism 35 expands the refrigerant which has been dissipated at the condenser. In the heating operation, the second heat exchanger 36 operates as a condenser to dissipate heat of the refrigerant compressed by the compressor 32. That is, the second heat exchanger 36 performs heat exchange using the refrigerant compressed by the compressor 32. In the cooling operation, the second heat exchanger 36 operates as an evaporator to heat the refrigerant by performing heat exchange between indoor air and the refrigerant expanded by the expansion mechanism 35.

Here, the refrigerant used in the refrigerating cycle device 110 is a mildly flammable refrigerant or a flammable refrigerant. Of the mainstream of refrigerants used in air conditioners, many are R410A, a refrigerant that is non-flammable. For a purpose of lowering GWP (Global Warming Potential), however, using an HFO-based refrigerant that is a mildly flammable refrigerant such as R32 or HFO1234ze is preferable. Or, for the purpose of lowering GWP, a flammable refrigerant such as an R290 refrigerant may be used.

The compressor 32 is a variable speed type that is inverter-driven.

A motor of the compressor, specifically, uses a direct current brushless motor (DC motor), and is driven by an inverter-driven device. The heat exchanger has a fan and a fan motor, and a DC motor is used in at least one place.

The refrigerating cycle apparatus 100, furthermore, includes the control device 120 that controls the refrigerating cycle of the refrigerating cycle device 110.

Figure 3:
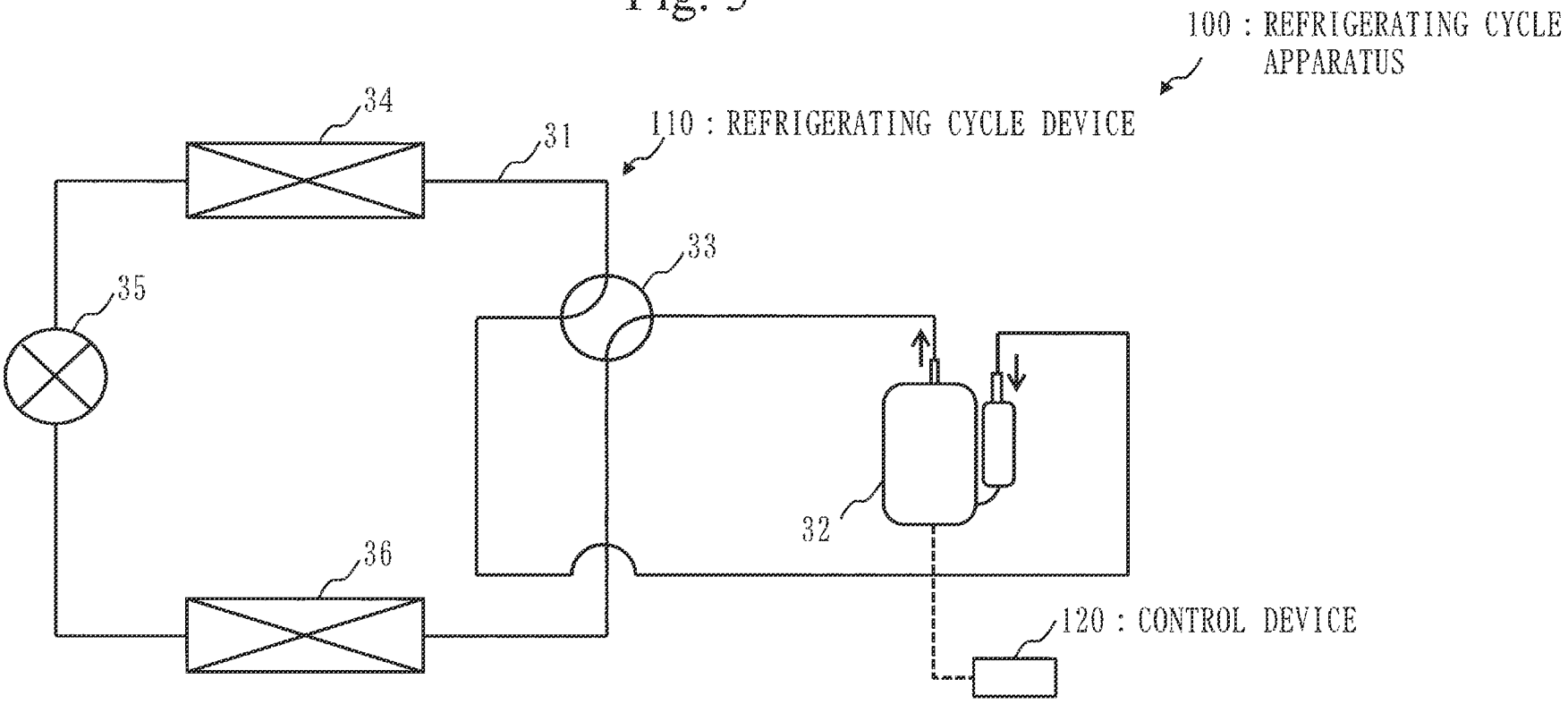
FIG. 3 is a refrigerant circuit during heating operation in a case where a refrigerating cycle device is an air conditioner.

Although only a connection between the control device 120 and the compressor 32 is illustrated in FIG. 2 and FIG. 3, the control device 120 may be connected not only to the compressor 32 but also to an element connected to the refrigerant circuit 31 other than the compressor 32. The control device 120 monitors and controls a state of each element connected to the control device 120.

Figure 4:
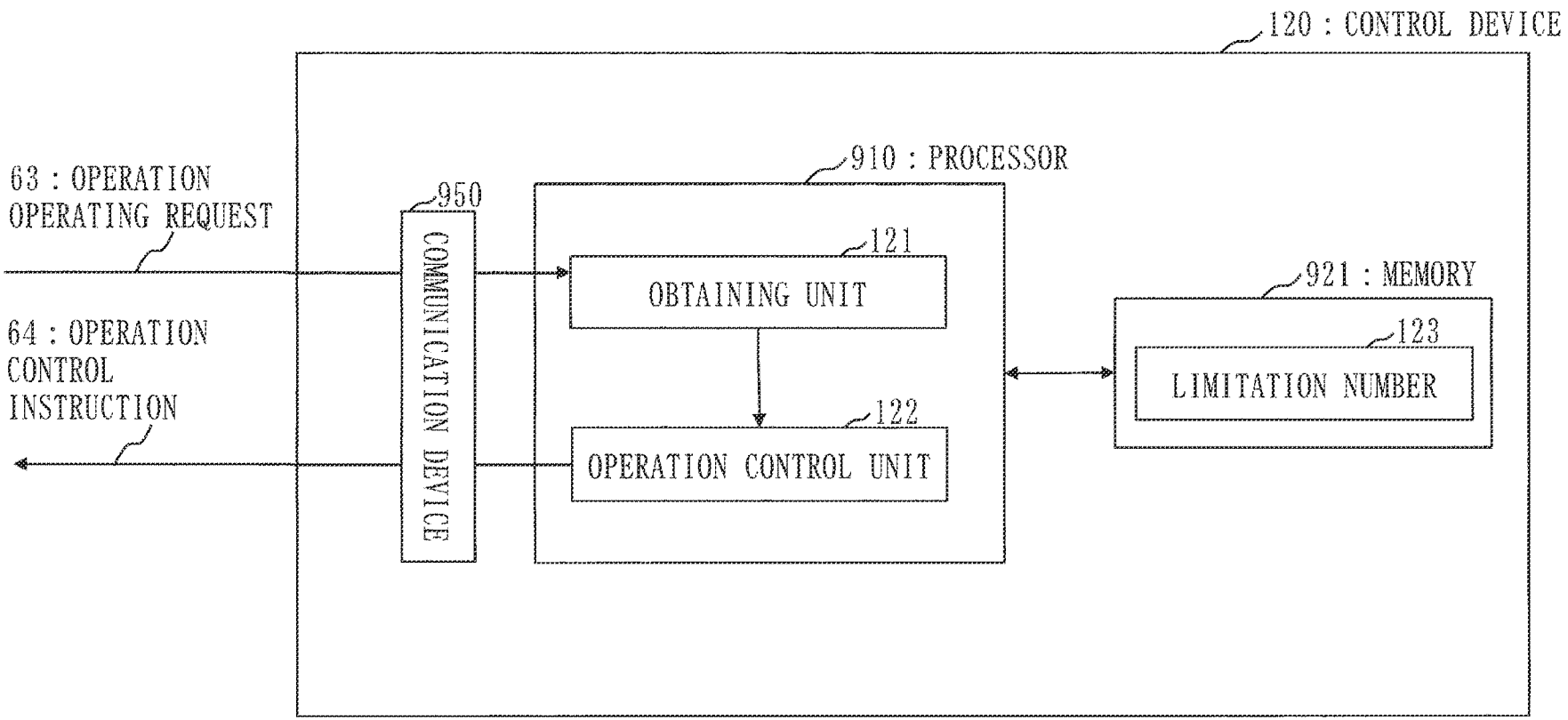
FIG. 4 is a configuration diagram of a control device according to Embodiment 1.

FIG. 4 is a diagram illustrating a configuration of the control device 120 according to the present embodiment.

The control device 120 is a computer. The control device 120 includes a processor 910 and other hardware such as a memory 921 and a communication device 950. The processor 910 is connected to other hardware via signal lines, and controls these other hardware. Although not illustrated, the control device 120 may, as other hardware, include an input interface, an output interface, and an auxiliary storage device.

The control device 120 includes, as functional elements, an obtaining unit 121 and an operation control unit 122. A limitation number 123 is stored in the memory 921.

Functions of the obtaining unit 121 and the operation control unit 122 are realized by software.

The processor 910 is a device that executes a refrigerating cycle control program. The refrigerating cycle control program is a program that realizes the functions of the obtaining unit 121 and the operation control unit 122.

The processor 910 is an IC (Integrated Circuit) that performs a calculation process. Specific examples of the processor 910 are a CPU (Central Processing Unit), a DSP (Digital Signal Processor), and a GPU (Graphics Processing Unit).

The memory 921 is a storage device that stores data temporarily. A specific example of the memory 921 is an SRAM (Static Random Access Memory) or a DRAM (Dynamic Random Access Memory).

The auxiliary storage device is a storage device that stores data. A specific example of the auxiliary storage device is an HDD. The auxiliary storage device may be a storage medium such as an SD (registered trademark) memory card, a CF, a NAND flash, a flexible disc, an optical disc, a compact disc, a Blu-ray (registered trademark) disc, or a DVD. HDD is an abbreviation for Hard Disk Drive. SD (registered trademark) is an abbreviation for Secure Digital. CF is an abbreviation for CompactFlash (registered trademark). DVD is an abbreviation for Digital Versatile Disk.

The input interface is a port connected to an input device such as a mouse, a keyboard, or a touch panel. The input interface, specifically, is a USB (Universal Serial Bus) terminal. The input interface may be a port connected to a LAN (Local Area Network).

The output interface is a port to which a cable of an output device such as a display is connected. The output interface, specifically, is a USB terminal or an HDMI (registered trademark) (High Definition Multimedia Interface) terminal. The display, specifically, is an LCD (Liquid Crystal Display).

A communication device has a receiver and a transmitter. The communication device is connected to the LAN, the Internet, or a communications network such as a telephone line. The communication device, specifically, is a communication chip or an NIC (Network Interface Card).

The refrigerating cycle control program is executed in the control device 120. The refrigerating cycle control program is read into the processor 910 and executed by the processor 910. Not only the refrigerating cycle control program but also an OS (Operating System) is stored in the memory 921. The processor 910 executes the refrigerating cycle control program while executing the OS. The refrigerating cycle control program and the OS may be stored in the auxiliary storage device. The refrigerating cycle control program and the OS stored in the auxiliary storage device are loaded into the memory 921 and executed by the processor 910. A part or all of the refrigerating cycle control program may be built into the OS.

The control device 120 may include a plurality of processors that replace the processor 910. These plurality of processors share execution of the refrigerating cycle control program. Each processor is, as with the processor 910, a device that executes the refrigerating cycle control program.

Data, information, signal values, and variable values used, processed, or outputted by the refrigerating cycle control program are stored in the memory 921, the auxiliary storage device, or a register or a cache memory in the processor 910.

"Unit" of each unit of the control device 120 may be replaced with "process", "procedure", or "step". "Process" with which "unit" of each unit of the control device 120 is replaced may be replaced with "program", "program product", "computer-readable storage medium having recorded a program", or "computer-readable recording medium having recorded a program".

The refrigerating cycle control program makes a computer execute each process, each procedure, or each step being "process", "procedure", or "step" with which "unit" of each unit described above is replaced. A refrigerating cycle control method is a method performed by the control device 120 executing the refrigerating cycle control program.

The refrigerating cycle control program may be provided being stored in a computer-readable recording medium. The refrigerating cycle control program may be provided as a program product.

Description of Operation

Figure 5:
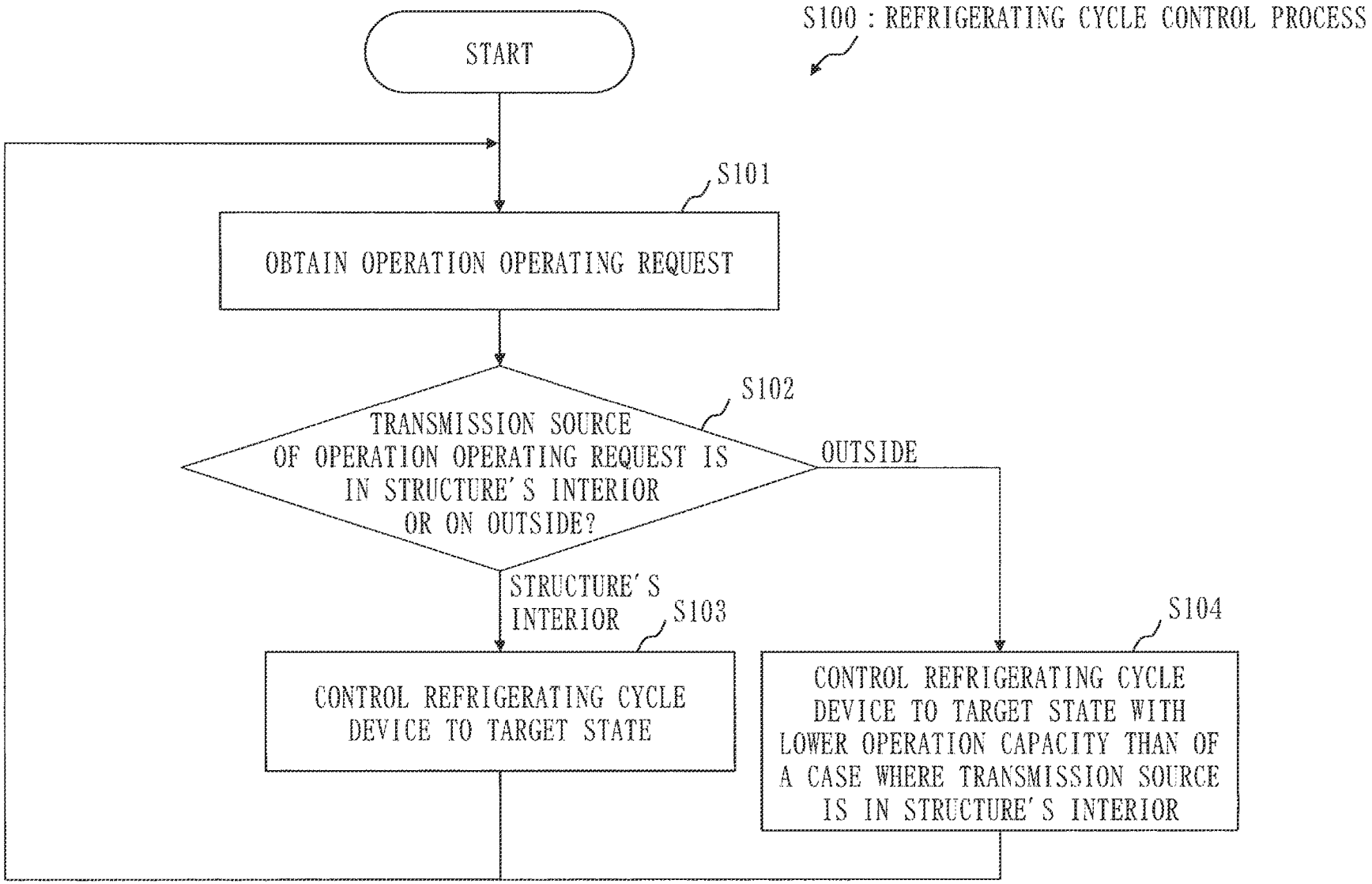
FIG. 5 is a flow diagram illustrating operation of the control device according to Embodiment 1

FIG. 5 is a flow diagram illustrating operation of the control device 120 according to the present embodiment.

Obtaining Process: Step S101

In step S101, the obtaining unit 121 obtains the operation operating request 63 that controls the refrigerating cycle device 110 arranged in the structure's interior 90 to the target state. In a case where the refrigerating cycle device 110 is in plurality, the obtaining unit 121 obtains the operation operating request 63 that controls the plurality of refrigerating cycle devices 110 to the target state. In a case where the refrigerating cycle device 110 is in plurality, the operation operating request 63 may specify a target state individually for each of the plurality of refrigerating cycle devices 110, or may specify one target state for all of the plurality of refrigerating cycle devices 110.

Operation Control Process: Step S102, Step S103, Step S104

When the operation control unit 122 obtains the operation operating request 63 transmitted from the outside 91, the operation control unit 122 controls the refrigerating cycle device 110 to the target state with lower operation capacity than operation capacity of the refrigerating cycle device 110 of a case where the operation operating request 63 is transmitted from the structure's interior 90.

Specifically, the operation control process is as follows.

In step S102, the operation control unit 122 verifies whether a transmission source of the operation operating request 63 is in the structure's interior 90 or on the outside 91. Specifically, in a case where the operation control unit 122 received the operation operating request 63 via the short range wireless communication 13 such as infrared communication or Bluetooth (registered trademark), the operation control unit 122 verifies that the transmission source of the operation operating request 63 is in the structure's interior 90. In a case where the operation control unit 122 received the operation operating request 63 via the wireless LAN 12 such as Wi-Fi (registered trademark), the operation control unit 122 verifies whether or not the operation operating request 63 is received via an external network 11. The operation control unit 122 verifies whether or not the operation operating request 63 is received via the external network 11 using information included in the operation operating request 63 such as a MAC (Media Access Control) address and an IP (Internet Protocol address) address of a destination, and a MAC address and an IP address of the transmission source.

In a case where the operation operating request 63 is not received via the network 11, the operation control unit 122 verifies that the transmission source of the operation operating request 63 is in the structure's interior 90. In a case where the operation operating request 63 is received via the network 11, the operation control unit 122 verifies that the transmission source of the operation operating request 63 is on the outside 91.

In a case where the transmission source of the operation operating request 63 is in the structure's interior 90, the process proceeds to step S103. In a case where the transmission source of the operation operating request 63 is on the outside 91, the process proceeds to step S104. A verification method of the transmission source of the operation operating request 63 described above is an example, and whether the transmission source of the operation operating request 63 is in the structure's interior 90 or on the outside 91 may be verified by other methods.

In step S103, the operation control unit 122 controls the refrigerating cycle device 110 to the target state based on the operation operating request 63. Specifically, the operation control unit 122 generates an operation control instruction 64 in a way that the refrigerating cycle device 110 will quickly become the target state, and transmits the operation control instruction 64 to the refrigerating cycle device 110.

In step S104, the operation control unit 122 controls the refrigerating cycle device 110 to the target state with lower operation capacity than the operation capacity of the refrigerating cycle device 110 of a case where the operation operating request 63 is transmitted from the structure's interior 90. The operation control unit 122 generates the operation control instruction 64 in a way that the refrigerating cycle device 110 will become the target state with lower operation capacity than the operation capacity of the refrigerating cycle device 110 of a case where the operation operating request 63 is transmitted from the structure's interior 90, and transmits the operation control instruction 64 to the refrigerating cycle device 110.

Specifically, the operation control unit 122 controls the operation capacity of the refrigerating cycle device 110 to be lower than operation capacity of a case where the operation operating request 63 is transmitted from the structure's interior 90, as follows.

When the operation control unit 122 obtains the operation operating request 63 transmitted from the outside 91, the operation control unit 122 controls operation capacity of the refrigerating cycle to be lower than operation capacity of a case where the operation operating request 63 is transmitted from a structure's interior in a way that time until the target state is reached will take long. At a time when the operation operating request 63 is given to the refrigerating cycle apparatus 100 from the outside 91, the operation control unit 122, even when operation operating is for a same temperature setting, performs operation in which operation capacity of a device is lowered compared with a case where an operation operating request is given to the refrigerating cycle apparatus 100 in the structure's interior 90. As described, the operation control unit 122 performs operation in a way that time until a set temperature is reached will take long.

When the operation control unit 122 obtains the operation operating request 63 transmitted from the outside 91, the operation control unit 122 may control the operation capacity of the refrigerating cycle to be low by limiting maximum electric power consumption of the refrigerating cycle to equal to or lower than rated electric power consumption.

The control device 120 may obtain information on electric power that is usable in a house in which the refrigerating cycle device 110 is arranged, as usable electric power information. The control device 120 may obtain information on electric power of electronic devices including the refrigerating cycle device 110, the electronic devices being the electronic devices used in the house, as electronic device electric power information. When the operation control unit 122 obtains the operation operating request 63 transmitted from the outside 91, the operation control unit 122 verifies whether or not total electric power of the electric power of the electronic devices exceeds the electric power that is usable in the house based on the usable electric power information and the electronic device electric power information. Then, in a case where the total electric power of the electric power of the electronic devices does not exceed the electric power that is usable in the house, the operation control unit 122 may start operation operating the refrigerating cycle device.

When the refrigerating cycle device 110 is in plurality, the operation control unit 122 controls the operation capacity of the refrigerating cycle device 110 to be lower than operation capacity of a case where the operation operating request 63 is transmitted from the structure's interior 90, as follows.

When the operation control unit 122 obtains the operation operating request 63 transmitted from the outside 91, the operation control unit 122 controls the operation capacity of each of the plurality of refrigerating cycle devices 110 to be lower than operation capacity of a case where operation of a single refrigerating cycle device is to be done.

When the operation control unit 122 obtains the operation operating request 63 transmitted from the outside 91, the operation control unit 122 may stagger operation starting points of at least some of the plurality of refrigerating cycle devices 110. That is, in a case where operating to start operation of the plurality of refrigerating cycle devices 110 is performed from the outside 91, the operation control unit 122 performs operation to delay operation starting time, and not start operation of the refrigerating cycle device 110 that is in plurality at a same time.

The control device 120 includes the memory 921 to store as the limitation number 123, the number of refrigerating cycle devices 110 that start operation operating at a same time in a case where the control device 120 obtained the operation operating request 63 transmitted from the outside 91. When the operation control unit 122 obtains the operation operating request 63 transmitted from the outside 91, the operation control unit 122 starts operation operating the limitation number 123 of refrigerating cycle devices 110 among the plurality of refrigerating cycle devices 110. As described, in a case where a plurality of refrigerating cycle devices 110 is to be operated from the outside 91, a limitation on the number of refrigerating cycle devices 110 that can be operated can be given in advance.

Next, a lower limit of capacity necessary in a case where maximum capacity is to be lowered at a time of operating from the outside 91 will be described with an air conditioner as an example.

As a feature of an inverter-driven air conditioner, when capacity for performing operation is lowered, energy consumption efficiency COP (Coefficient Of Performance) usually improves. On the contrary, however, when the capacity is excessively lowered, COP falls. Consequently, COP around intermediate capacity corresponding to one-half capacity of approximate rated capacity is highest. Consequently, in a case where energy savings is to be regarded as important, when operation is performed in a way that the maximum capacity of the air conditioner is around the intermediate capacity at a start of operation, the operation that is highest in energy savings becomes possible.

Next, whether or not a problem occurs in air conditioning capacity in a case where the capacity at the start of operation is lowered to approximately one-half of the rated capacity will be considered.

In recent years, due to increase in energy savings in houses, houses are becoming more airtight. Specifically, under an energy saving standard of the 1980's, a heat loss coefficient Q-value of a house in Tokyo area is 5.2 $W/m^2 \cdot K$, whereas a heat loss coefficient Q-value under a new energy saving standard value of the year 1999 is 2.7 $W/m^2 \cdot K$. As described, the heat loss coefficient of a house as a whole is approximately half, and energy savings in houses have further increased in recent years. The heat loss coefficient Q-value means an amount of heat necessary to change 1 degree of a temperature per 1 $m^2$ of floor space of a house.

For an average house to be considered, taking resale houses into consideration, an air conditioning load of the house is calculated based on the heat loss coefficient of a house in the 1980's. Specifically, to raise room temperature of a room of an eight-mat size (13 $m^2$ of floor space) in a house built of wood to 20 degrees with an outdoor temperature being 0 degrees, the amount of heat of 1350 W needs to be added. By contrast, a device selection in a case where a room of eight-mat size in a house built of wood is to be air conditioned, the selection is performed for a device that demonstrates rated heating capacity of approximately 3600 W, which is more than double the capacity.

This means that, because the heat loss coefficient of the house is a heat loss of the entire house, the air conditioning capacity obtained from here is different from capacity necessary in a case where operation of an air conditioner is to be actually done. A major factor for the above, specifically, is that in wintertime, an amount of heat for heating a wall surface that has become cold, or in summertime, an amount of heat necessary for cooling a wall surface that has become warm is added in a large amount. The amount of heat such as the above is called a heat storage load of a house. Other than the above, there are a heat loss to an adjacent room, an amount of heat for ventilation, and an amount of heat of latent heat for removing humidity of a structure's interior in summertime. Consequently, since there is usually an occupant at a time of starting air conditioning, operation is necessary to be done with high capacity having sufficient margin in the air conditioning capacity in a way that problems would not occur even when the air conditioning load such as the heat storage load of a house exists, to quickly bring the temperature close to the set temperature.

In a case where an air conditioner is to be operated from an outside, however, since there is no necessity for quickly reaching a set temperature from a start of operation of the air conditioner, an effect of the heat storage load of the house is mitigated, and the air conditioning capacity will be close to capacity of air conditioning obtained from the heat loss coefficient of the house. Consequently, even when maximum capacity is lowered to approximately one-half of the rated capacity, the temperature will become close to the set temperature in many cases. Of course, depending on an environmental factor such as an outdoor temperature or on a temperature setting condition, a case where the temperature does not reach the set temperature exists, but satisfying a goal to ease discomfort when returning home is possible.

Next, an example of a simple control method to lower the capacity to approximately one-half of the rated capacity will be described.

In a typical air conditioner, there are many cases where the device itself is not detecting the air conditioning capacity during operation. Therefore, since control based on the air conditioning capacity is difficult, control will become easier by detecting and controlling a rotational speed of the compressor that is being driven, electric power consumption, or an electric current during operation.

That is, in a case where control is to be done easily, having the electric power consumption that is approximately one-half of the rated electric power consumption as a standard, when control is done in a way to secure minimum capacity at a time of operation operating the air conditioner from the outside, control can be done easily. Or, in a case where control is to be done by an electric current during operation, having the electric current that is one-half of the electric current during operation when the rated electric power consumption is demonstrated as a standard, when control is done in a way to secure minimum capacity at a time of operation operating the air conditioner from the outside, control can be done easily. Or, having approximately one-half of the rotational speed of the compressor during operation at rated capacity as a standard, when control is done in a way to secure minimum capacity when operation operating the air conditioner from the outside, control can be done easily.

Because of the above, in a case where operation of the air conditioner is to be operated from the outside and operation is to be done with capacity being lowered, the air conditioner is controlled in a way that the maximum capacity is from approximate rated capacity to approximately one-half of the rated capacity. That is, in a case where control of the air conditioner is to be done easily, the air conditioner is controlled in a way that an upper limit of the maximum electric power consumption of the air conditioner is between approximate rated electric power consumption and one-half of the rated electric power consumption. Or, in a case where the air conditioner is to be controlled by the rotational speed of the compressor, the air conditioner is controlled in a way that an upper limit of an approximate rotational speed of the air conditioner is from the rotational speed of the compressor at the rated capacity to one-half of the rotational speed of the compressor at the rated capacity.

Other Configurations

Variation 1

In the present embodiment, the functions of the obtaining unit 121 and the operation control unit 122 are realized by software. As a variation, the functions of the obtaining unit 121 and the operation control unit 122 may be realized by hardware.

Figure 6:
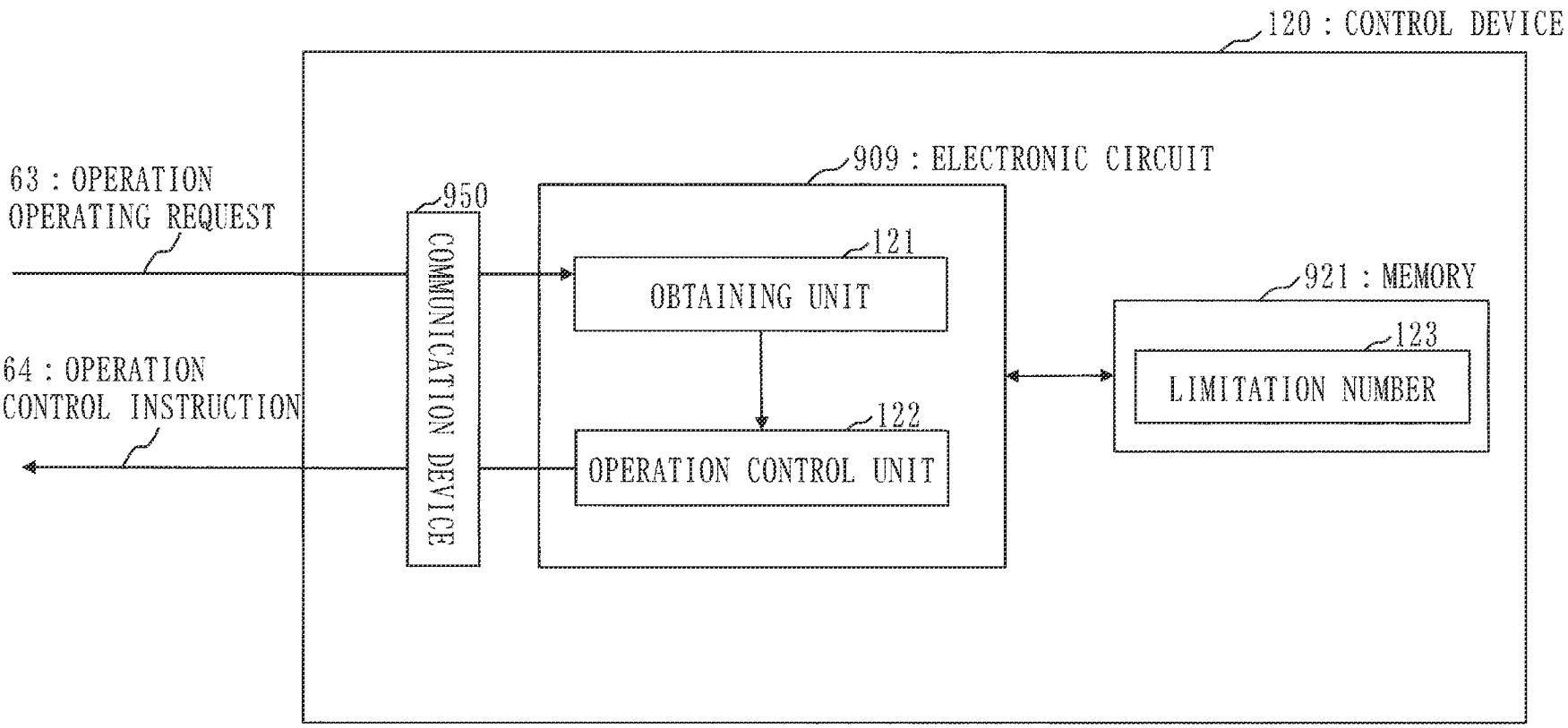
FIG. 6 is a configuration diagram of a control device according to a variation of Embodiment 1.

FIG. 6 is a configuration diagram of a control device 120 according to the variation of the present embodiment.

The control device 120 includes an electronic circuit 909, the memory 921, and the communication device 950.

The electronic circuit 909 is a dedicated electronic circuit to realize the functions of the obtaining unit 121 and the operation control unit 122.

The electronic circuit 909, specifically, is a single circuit, a composite circuit, a programmed processor, a parallel programmed processor, a logic IC, a GA, an ASIC, or an FPGA. GA is an abbreviation for Gate Array. ASIC is an abbreviation for Application Specific Integrated Circuit. FPGA is an abbreviation for Field-Programmable Gate Array.

The functions of the obtaining unit 121 and the operation control unit 122 may be realized by one electronic circuit or may be realized by being distributed to a plurality of electronic circuits.

As another variation, a part of the functions of the obtaining unit 121 and the operation control unit 122 may be realized by the electronic circuit and the rest of the functions may be realized by software.

As another variation, a part of or all of the functions of the obtaining unit 121 and the operation control unit 122 may be realized by firmware.

Each of the processor and the electronic circuit are also called processing circuitry. That is, in the control device 120, the functions of the obtaining unit 121 and the operation control unit 122 are realized by the processing circuitry.

Description of Effect of Embodiment

Here, having an air conditioner as an example of the refrigerating cycle device, in a case where the air conditioner is to be operated from the outside, differing points from when the air conditioner is operated in the structure's interior where the air conditioner is commonly used will be described.

When operation of the air conditioner is performed in the structure's interior, generally, there are many cases where a way of using the air conditioner is performed in which air conditioning is done when there is an occupant. Consequently, at a time of operation operating of the device, normally, a user performs operation after checking whether or not there is an object placed around the device that interferes with the operation or whether or not there is an unsafe object placed in a periphery of the device. Furthermore, if in a case where an abnormality occurs in an electrical system or in the device, the user will notice the abnormality by a smell that develops before a fire or smoke, and takes safety measures for abnormal times such as stopping the device. Suppose that a fire is started, a measure for extinguishing fire will be taken in a way to prevent a spread of disaster. Consequently, the abnormality was difficult to develop into a serious accident, and was difficult to lead to a big disaster such as a fatal accident.

On the other hand, in the structure's interior, when a person who lives in the house is not home or there is an elderly person who is bedridden and is necessary to be nursed, in a case where operation operating the air conditioner is to be done from the outside, a safety check before operation of a device cannot be performed or an avoidance measure during a time of abnormality cannot be taken when there is an abnormality, making a risk of the above leading to serious accidents become higher.

Furthermore, when operating of the air conditioner is to be performed in the structure's interior, normally, a case in which performing a usage where only a room with an occupant is air conditioned is typical. In a case where the air conditioner is to be operated from the outside, however, there is a case where every room in which there is a possibility of a person residing after coming home is air conditioned. In such a case, since air conditioners in a plurality of rooms are started at a same time, extremely high electric power will be used compared with a case where air conditioning is done in daily life in which the air conditioner is operated in the structure's interior. Consequently, a risk of an accident occurring is made even higher.

Not only the problem at a time of abnormality in the air conditioner but in daily life, even when an electric power usage amount is within an electric power contracted with an electric power company, in a case where the air conditioner is to be operated from the outside, by operating devices such as a plurality of air conditioners at the same time, there is a case where the electric power becomes higher than the electric power contracted. By the above, there is a risk of a problem occurring where an electric current breaker shuts off in a home, none of the electricity in the home can be used, and of course, operating of Wi-Fi (registered trademark) from then on cannot be done. Especially at a time when an elderly who needs nursing is using medical devices that use electricity, there is a risk of a serious accident being caused that affect people's lives.

Next, a risk associated with an air conditioner of recent years will be described.

For the refrigerant used in the air conditioner that uses the refrigerating cycle, using a non-flammable refrigerant such as R22 or R410A was the mainstream. In recent years, however, for preventing global warming or to promote energy savings, a refrigerant that is flammable such as R32 Freon refrigerant has come to be used in the mainstream.

Furthermore, use of a refrigerant that is more flammable such as use of a flammable HFO-based refrigerant such as HFO1234ze that is presumed to be more highly effective in preventing global warming than R32 refrigerant, or use of a natural refrigerant such as R290 that is highly flammable, is to become more practical from now on. That is, in a case where these flammable refrigerants are used, when an accident occurs, the accident is likely to lead to a more serious accident.

Consequently, reducing risks leading to accidents are to become more essential from now on. Consequently, in the use of operation operating of the air conditioner from the outside, there is increasing importance of further reducing risks that may lead to accidents.

In the above, the description was done with the air conditioner that uses the refrigerating cycle as an example, but even with the floor heating or the hot water supply that uses the refrigerating cycle, each is a device that uses Carnot cycle, a principle of each is the same as a principle of the air conditioner, and each is a device that necessitates a large amount of electricity as with the air conditioner, and it can be said that a same issue exists.

Hereinafter, an effect of a refrigerating cycle apparatus according to the present embodiment will be described.

In the refrigerating cycle apparatus according to the present embodiment, in a case where the refrigerating cycle device is to be operated from the outside, since the refrigerating cycle device is controlled to a target state with low operation capacity, occurrence of an accident during operation operating can be prevented.

Hereinafter, a description of the effect of the embodiment regarding a device that uses the refrigerating cycle will be given with an air conditioner as an example.

In a case of an air conditioner that uses a refrigerating cycle that drives an inverter, an upper limit of cooling or heating capacity that the air conditioner can demonstrate being higher than the rated capacity used at a time of specifying the applicable number of mats, that is, an applicable floor space of the air conditioner, is typical. The upper limit of cooling or heating capacity that the air conditioner can demonstrate is called maximum capacity. Electric power consumption during this time is called maximum electric power consumption.

The maximum capacity is provided to quickly bring a temperature of a room close to a set temperature when the air conditioner is started, and is a significant feature of being inverter-driven. The electric power consumption, however, becomes higher in a case where the maximum capacity is demonstrated than the electric power consumption when demonstrating normal rated capacity.

In a normal usage of the air conditioner where the air conditioner comes into operation at a time of a family member returning home, quickly bringing the temperature of the room close to the set temperature as described makes the room very comfortable. When operation of the air conditioner is done from outside, however, it is not necessary to quickly bring the temperature of the room close to the set temperature.

Furthermore, energy efficiency of the air conditioner is generally indicated by energy consumption efficiency COP (Coefficient of performance) calculated based on a ratio of air conditioning capacity (W) to electric power consumption during air conditioning (W). The larger the value of this COP, the more efficient the operation.

An air conditioner that is typically on the market at present will be illustrated as an example. Specifically, to illustrate a domestic wall mounted air conditioner with rated capacity 2.8 KW as an example, there is a device in which COP of heating during when the rated capacity is demonstrated is 4.0, whereas heating COP during when the maximum capacity is demonstrated is 3.2. As described, in the air conditioner that is inverter-driven, COP during when the operation is done at the maximum capacity is generally lower than COP during when the operation is done at the rated capacity. That is, in a case where the air conditioner is to be operated from a place where one has gone out to, it is not necessary to quickly bring the temperature of the room close to the set temperature since no one is in the room in the first place. Consequently, instead, when the operation is done with the operation capacity being lowered, the energy efficiency is higher and energy saving operation is possible.

Making use of the features above, the air conditioner of which operation operating from the outside such as a place where one has gone out to is possible using Wi-Fi (registered trademark) wireless, in a case where an operation instruction is to be given to the refrigerating cycle apparatus from the outside, it is not necessary for the air conditioner quickly bring the temperature close to the set temperature by demonstrating the maximum capacity. Therefore, even when operation operating is for a same temperature setting, by performing operation in which operation capacity of a device is lowered, electric power consumption used is lowered and a risk of an accident occurring can be reduced compared with a case where the operation instruction for the refrigerating cycle apparatus is given in the structure's interior. Furthermore, performing operation that is high in energy consumption efficiency is made possible, which in turn contributes also to energy savings.

Similarly, in a case where operating to start operation of a plurality of refrigerating cycle devices is performed from the outside, due to a large amount of electric power being used suddenly, the electric power exceeds contracted electric power of a home, and a risk of a breaker of a switchboard being stopped increases. By suddenly increasing the electric power consumption used, an amount of heat of a power line in a home increases, and a risk of an accident occurring increases.

To reduce this kind of risk, when operation of the plurality of refrigerating cycle devices is to be done at the same time, operation in which capacity of a device is lowered is automatically performed compared with a case where an operation instruction is given to a single refrigerating cycle apparatus. By the above, the electric power consumption used is reduced, which in turn makes lowering of a risk of the breaker of the switchboard stopping or of an accident possible. Operation that is high in energy consumption efficiency is made possible, which in turn contributes also to energy savings.

Next, another system to reduce a risk in a case where operating of starting operation of the plurality of refrigerating cycle devices is performed from the outside will be described.

In a case where operation operating of the plurality of refrigerating cycle devices is done from the outside, a user sets an order of when the refrigerating cycle devices start running in advance. By the above, in a case where operation start operating of the plurality of refrigerating cycle devices is performed from the outside, operation of the plurality of refrigerating cycle devices is started as needed with each refrigerating cycle device being at certain regular time intervals according to the order of when the operation is to start. When the refrigerating cycle device is an air conditioner, since a plurality of air conditioners are not driven at the same time, regulating a large amount of electric power consumption that occurs at the start of operation is possible. Consequently, a risk of an accident occurring or of stopping of the breaker of the switchboard occurring can be prevented.

Next, a standard for when lowering capacity of a device in a case where the refrigerating cycle device is operated from the outside will be stated. Generally, in a case of an air conditioner, a floor space of a house in which the air conditioner is possible to be arranged is set according to rated capacity.

Specifically, for a domestic air conditioner, according to JISC9612, the rated capacity necessary during heating a house that is built of wood, facing south, and is one-storied is 275 W/m$^2$. In a room of eight-mat size, since a floor space is approximately 13 m$^2$, an air conditioner with rated heating capacity of 3575 W (approximately 3600 W) will be selected. In a case where a device is set as described, even when an outdoor temperature is 0 degrees, heating the room up to approximately 20 degrees is possible.

In a case of an air conditioner that is inverter-driven, maximum capacity of capacity that exceeds this rated capacity can be demonstrated, but this is the capacity necessary for quickly bringing a temperature of a room to reach a set temperature. That is, the higher the maximum capacity, the quicker the temperature of the room reaches the set temperature. In a case where the air conditioner is to be operated from the outside, however, since it is not necessary for the temperature of the room to quickly reach the set temperature, when the operation of the air conditioner is done, it is preferable to lower the maximum capacity to capacity that is lower than the rated capacity. By doing as described, the electric power consumption at the start of operation of the air conditioner is possible to be lowered to around the rated electric power consumption, and a risk of an accident or a risk of the breaker of the switchboard stopping can be reduced. Furthermore, the energy efficiency increases and energy savings improves in the air conditioner.

Embodiment 2

In the present embodiment, parts different from those of Embodiment 1 will mainly be described. There are cases where the same configurations as those of Embodiment 1 are denoted by the same reference signs, and the descriptions being omitted.

Description of Configuration

Figure 7:
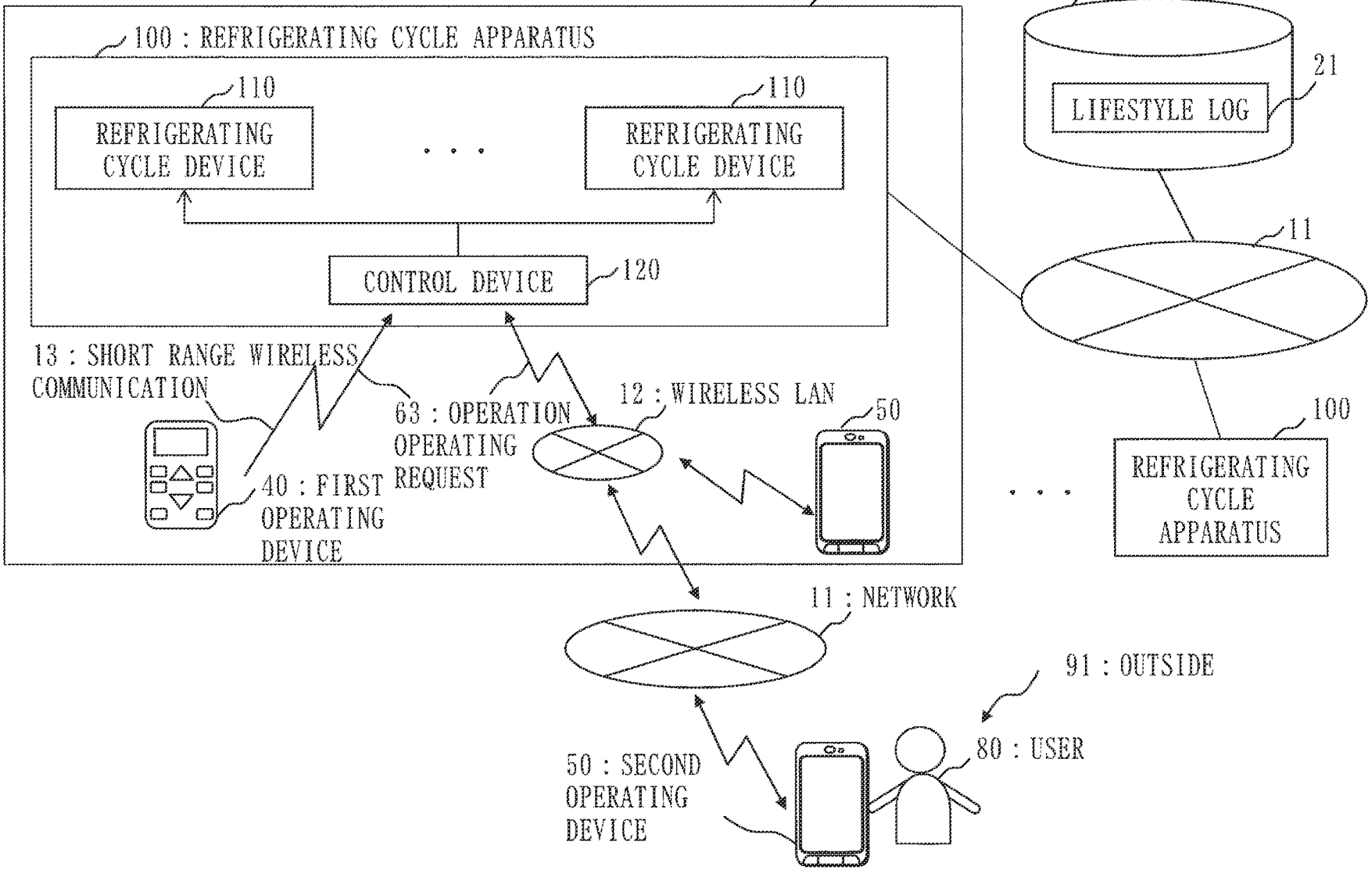
FIG. 7 is a configuration diagram of a refrigerating cycle control system according to Embodiment 2.

FIG. 7 is a diagram illustrating a configuration of a refrigerating cycle control system 500 according to the present embodiment.

The refrigerating cycle control system 500 of FIG. 7, in addition to the configuration of FIG. 1, includes a file server 20 that communicates with the refrigerating cycle apparatus 100 via the network 11.

The refrigerating cycle control system 500 has the file server 20, and the refrigerating cycle apparatus 100 that includes the refrigerating cycle device 110 and the control device 120.

The file server 20 is able to communicate with the control device 120 via the network 11. The file server 20, specifically, is a cloud server included in a cloud system.

A lifestyle log 21 that shows a lifestyle of the user 80 of the refrigerating cycle device 110 is stored in the file server 20.

Figure 8:
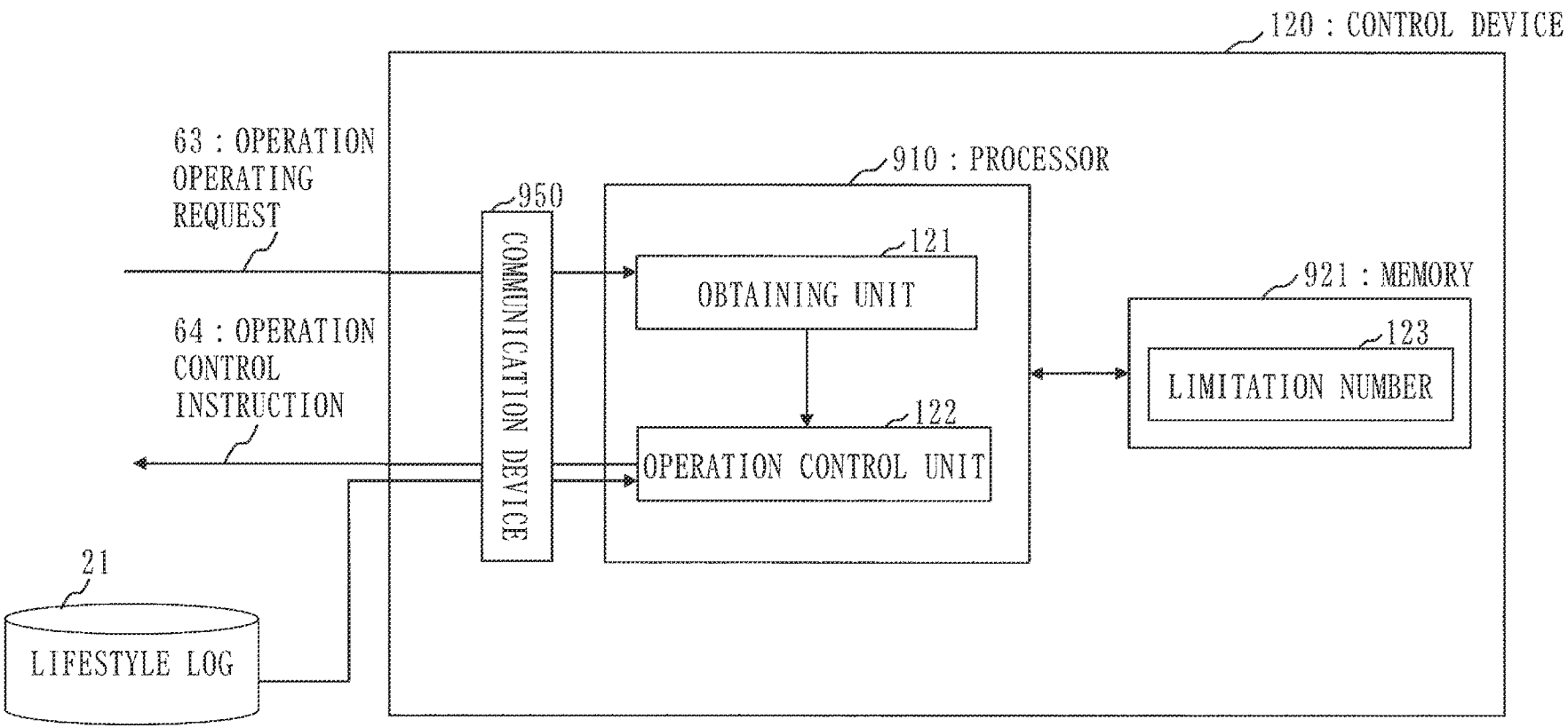
FIG. 8 is a configuration diagram of a control device according to Embodiment 2.

FIG. 8 is a diagram illustrating a configuration of a control device 120 according to the present embodiment.

In the present embodiment, the operation control unit 122 obtains the lifestyle log 21 via the communication device 950.

The obtaining unit 121 obtains the operation operating request 63 that requests the refrigerating cycle device 110 arranged in the structure's interior 90 to be controlled to the target state.

When the operation control unit 122 obtains the operation operating request 63 transmitted from the outside 91, the operation control unit 122, based on the lifestyle log 21, controls the refrigerating cycle device 110 to the target state with lower operation capacity than the operation capacity of the refrigerating cycle device 110 of a case where the operation operating request 63 is transmitted from the structure's interior 90.

FIG. 9 is a diagram illustrating an example of the lifestyle log 21 according to the present embodiment.

The lifestyle log 21 shows the lifestyle of the user 80. A lifestyle 521 that shows the lifestyle of the user 80 is set in the lifestyle log 21. Information such as a living area 522 that shows an area in which a user is living may be set in the lifestyle log 21.

Information for specifying the lifestyle of the user 80 is set in the lifestyle log 21. In the present embodiment, as an example, information such as season, weather, day attribute, and daily life situation is set. Other than the above, various information to specify a lifestyle is desirable to be set. Specifically, information such as sex, age, family structure, employment status, behavioral pattern, preference, or information of the house of the user 80 is desirable to be included. Vital signs of a human body such as blood pressure, heartbeat, and respiration are desirable to be included. Based on these lifestyles 521, the lifestyle itself is recognized as an attribute of the user. As a specific example, when the user 80 is of a family of two people, a man in his 30's and a woman in her 30's, recognizing as far as whether or not the family is a dual-income family with no children is desirable. Behavioral patterns such as at what time the user 80 gets up, leaves the house, returns home, bathes, and goes to sleep are desirable to be recognized as an attribute. Preference such as whether the user 80 is sensitive to heat or sensitive to the cold may be recognized as an attribute. The information of the house in which the refrigerating cycle device 110 is positioned may be recognized.

Description of Operation

Figure 10:
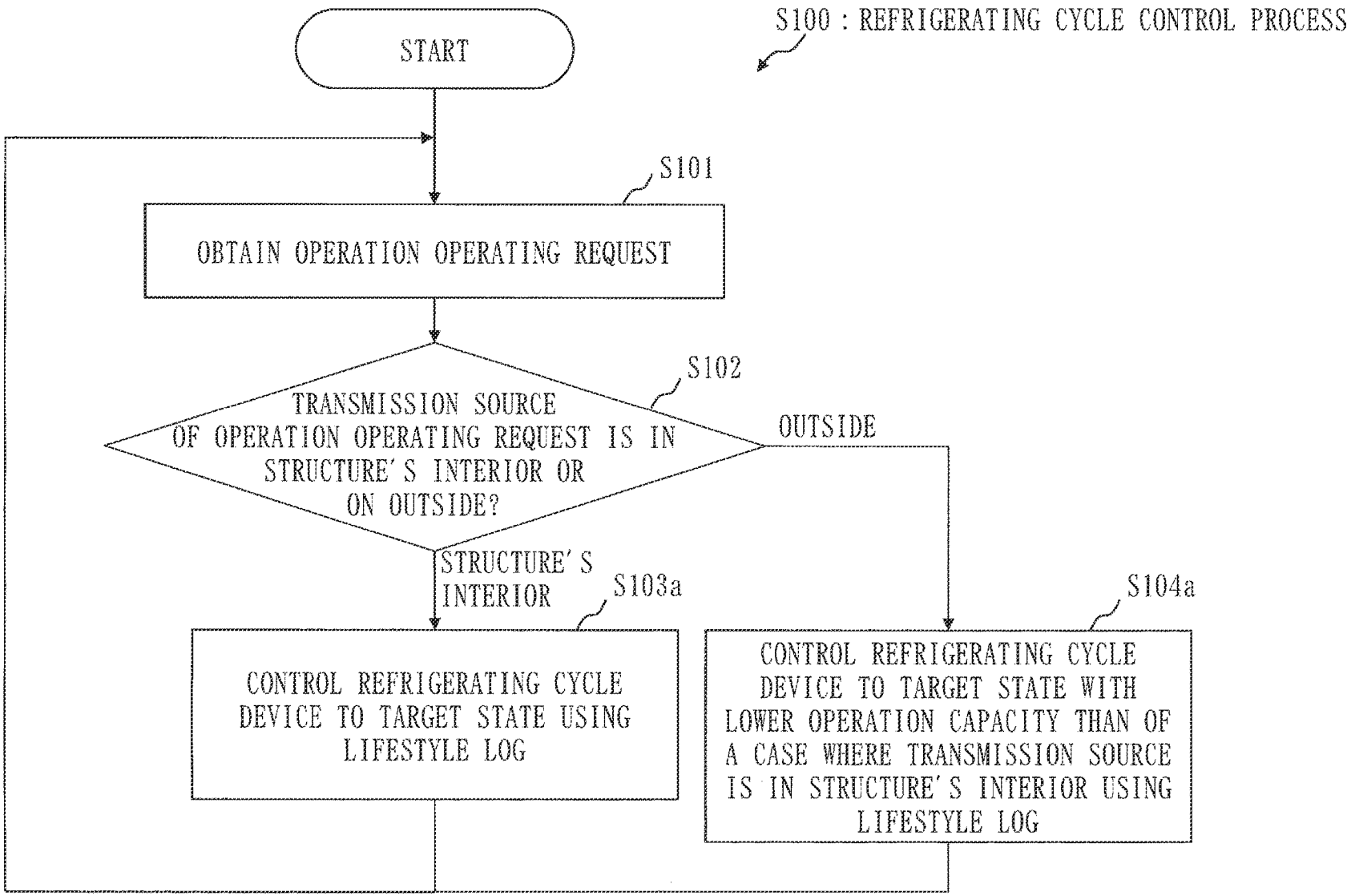
FIG. 10 is a flow diagram illustrating operation of the control device according to Embodiment 2.

FIG. 10 is a flow diagram illustrating operation of the control device 120 according to the present embodiment.

Step S101 and step S102 are the same as the steps in Embodiment 1.

In step S103*a* and step S104*a*, in addition to the functions that are the same as the functions in Embodiment 1, the operation control unit 122 performs operation control of the refrigerating cycle device 110 based on the lifestyle log 21.

In step S103*a*, the operation control unit 122 controls the refrigerating cycle device 110 to the target state based on the lifestyle log 21 and the operation operating request 63. Specifically, the operation control unit 122 generates the operation control instruction 64 in a way that the refrigerating cycle device 110 will quickly become the target state and taking into account the lifestyle log 21, and transmits the operation control instruction 64 to the refrigerating cycle device 110.

In step S104*a*, the operation control unit 122, based on the lifestyle log 21 and the operation operating request 63, controls the refrigerating cycle device 110 to the target state with lower operation capacity than the operation capacity of the refrigerating cycle device 110 of a case where the operation operating request 63 is transmitted from the structure's interior 90. The operation control unit 122 generates the operation control instruction 64 in a way that the refrigerating cycle device 110 will become the target state with lower operation capacity than the operation capacity of the refrigerating cycle device 110 of a case where the operation operating request 63 is transmitted from the structure's interior 90 and taking into account the lifestyle log 21, and transmits the operation control instruction 64 to the refrigerating cycle device 110.

That is, in addition to the same functions in Embodiment 1, the operation control unit 122 adjusts the target state of the refrigerating cycle device 110 in line with the preference of the user 80 according to the lifestyle of the user 80. Specifically, when the user 80 performs operation operating of the refrigerating cycle device 110 from a place where the user 80 has gone out to, the operation control unit 122 may set an appropriate target state based on the lifestyle log 21 without the user 80 specifically specifying the target state.

Description of Effect of Present Embodiment

According to a refrigerating cycle control system of the present embodiment, in a case where the refrigerating cycle device is to be operated from the outside, occurrence of an accident during operation operating can be prevented, energy savings is realized, and operation control that is suitable for the user can be realized.

In Embodiments 1 to 2 above, each unit of the control device is described as an independent functional block. The configuration of the control device, however, does not have to be in the configuration as in the embodiments described above. The functional block of the control device may be in any configuration as long as the functions described in the embodiments described above can be realized. The control device may be a system configured of a plurality of devices, not of one device.

Of Embodiments 1 to 2, a plurality of parts may be combined and executed. Or, of these embodiments, one part may be executed. In addition, these embodiments may be combined and executed in any manner, either fully or partially.

That is, in Embodiments 1 to 2, a free combination of each embodiment, a variation of any element in each embodiment, or omitting of any element in each embodiment is possible.

The embodiments described above are essentially preferred examples, and are not intended to limit the scope of the present invention, the scope of application of the present invention, and the scope of use of the present invention. Various changes are possible to be made to the embodiments described above as necessary.

The invention claimed is:

1. A refrigerating cycle apparatus comprising:

a plurality of refrigerating cycle devices, each having a refrigerating cycle, the refrigerating cycle in which a refrigerant is compressed in a compressor and made to circulate, and by a heat exchanger, heat is absorbed from a low temperature heat source and heat is exhausted to a high temperature heat source; and a control device to control operation of the plurality of refrigerating cycle devices, wherein the control device includes processing circuitry to obtain an operation operating request that controls the plurality of refrigerating cycle devices arranged in a structure's interior to a target state, and when the operation operating request transmitted from an outside is obtained, to control the plurality of refrigerating cycle devices to the target state with lower operation capacity than operation capacity of the plurality of refrigerating cycle devices of a case where the operation operating request is transmitted from the structure's interior, and when the operation operating request transmitted from the outside is obtained, staggers operation starting points of at least some of the plurality of refrigerating cycle devices.

2. The refrigerating cycle apparatus according to claim 1, wherein the processing circuitry when the operation operating request transmitted from the outside is obtained, controls operation capacity of each of the plurality of refrigerating cycle devices to be lower than operation capacity of a case where operation of a single refrigerating cycle device is done.

3. The refrigerating cycle apparatus according to claim 1, wherein the processing circuitry includes a memory to store, as a limitation number, the number of refrigerating cycle devices that start operation operating at a same time in a case where the operation operating request transmitted from the outside is obtained, and when the operation operating request transmitted from the outside is obtained, starts operation operating the limitation number of refrigerating cycle devices among the plurality of refrigerating cycle devices.

4. The refrigerating cycle apparatus according to claim 1, wherein the processing circuitry when the operation operating request transmitted from the outside is obtained, controls operation capacity of the refrigerating cycle to be lower than operation capacity of a case where the operation operating request is transmitted from the structure's interior in a way that time until the target state is reached will take long.

5. The refrigerating cycle apparatus according to claim 1, wherein the processing circuitry when the operation operating request transmitted from the outside is obtained, controls the operation capacity of the refrigerating cycle to be low by limiting maximum electric power consumption of the refrigerating cycle to equal to or lower than rated electric power consumption.

6. The refrigerating cycle apparatus according to claim 1, wherein the processing circuitry when the operation operating request transmitted from the outside is obtained, based on information on electric power that is usable in a house in which the plurality of refrigerating cycle devices are arranged and information on electric power of electronic devices including the plurality of refrigerating cycle devices, the electronic devices being the electronic devices used in the house, verifies whether or not total electric power of the electric power of the electronic devices exceeds the electric power that is usable in the house, and in a case where the total electric power does not exceed the electric power that is usable in the house, starts operation operating the plurality of refrigerating cycle devices.

7. The refrigerating cycle apparatus according to claim 1, wherein the refrigerant used in each of the plurality of refrigerating cycle devices is a mildly flammable refrigerant or a flammable refrigerant.

8. A refrigerating cycle control system comprising:

a file server; and a refrigerating cycle apparatus including a plurality of refrigerating cycle devices, each having a refrigerating cycle, the refrigerating cycle in which a refrigerant is compressed in a compressor and made to circulate, and by a heat exchanger, heat is absorbed from a low temperature heat source and heat is exhausted to a high temperature heat source, and a control device to control operation of the plurality of refrigerating cycle devices, wherein the file server includes a lifestyle log that shows a lifestyle of a user of the plurality of refrigerating cycle devices, and the control device includes processing circuitry to obtain an operation operating request that controls the plurality of refrigerating cycle devices arranged in a structure's interior to a target state, and when the operation operating request transmitted from an outside is obtained, based on the lifestyle log, to control the plurality of refrigerating cycle devices to the target state with lower operation capacity than operation capacity of the plurality of refrigerating cycle devices of a case where the operation operating request is transmitted from the structure's interior, and when the operation operating request transmitted from the outside is obtained, staggers operation starting points of at least some of the plurality of refrigerating cycle devices.

9. A refrigerating cycle control method of a refrigerating cycle apparatus, wherein the refrigerating cycle apparatus includes a plurality of refrigerating cycle devices, each having a refrigerating cycle, the refrigerating cycle in which a refrigerant is compressed in a compressor and made to circulate, and by a heat exchanger, heat is absorbed from a low temperature heat source and heat is exhausted to a high temperature heat source, and a control device to control operation of the plurality of refrigerating cycle devices, the refrigerating cycle control method comprising:

obtaining an operation operating request that controls the plurality of refrigerating cycle devices arranged in a structure's interior to a target state;

when the operation operating request transmitted from an outside is obtained, controlling the plurality of refrigerating cycle devices to the target state with lower operation capacity than operation capacity of the plurality of refrigerating cycle devices of a case where the operation operating request is transmitted from the structure's interior; and when the operation operating request transmitted from the outside is obtained, staggering operation starting points of at least some of the plurality of refrigerating cycle devices.

* * * * *